US007383640B2

(12) United States Patent
Barry

(10) Patent No.: US 7,383,640 B2
(45) Date of Patent: Jun. 10, 2008

(54) QUILTING TEMPLATE SYSTEM

(76) Inventor: Patricia C. Barry, 5640 Tracy Cir., Racine, WI (US) 53402

( * ) Notice: Subject to any disclaimer, the term of this patent is extended or adjusted under 35 U.S.C. 154(b) by 86 days.

(21) Appl. No.: 11/413,740

(22) Filed: Apr. 28, 2006

(65) Prior Publication Data

US 2007/0251111 A1 Nov. 1, 2007

(51) Int. Cl.
*B43L 13/20* (2006.01)
*G01B 3/14* (2006.01)

(52) U.S. Cl. ..... 33/562; 33/1 G; 33/565

(58) Field of Classification Search ..... 33/562–566, 33/1 SD, 1 B, 1 G, 458, 11–12
See application file for complete search history.

(56) References Cited

U.S. PATENT DOCUMENTS

| | | | |
|---|---|---|---|
| 205,795 | A | 7/1878 | Green |
| 242,696 | A | 6/1881 | Robinson |
| 364,508 | A | 6/1887 | Griffiths |
| 503,741 | A | 8/1893 | Faestel |
| 613,095 | A | 10/1898 | Van Dame |
| 616,493 | A | 12/1898 | Richardson |
| 644,756 | A | 3/1900 | Bailey |
| 709,776 | A | 9/1902 | Kelley |
| 720,824 | A | 2/1903 | Lieber et al. |
| 909,023 | A | 1/1909 | Ratner |
| 1,108,040 | A | 8/1914 | Watters |
| 1,329,411 | A | 2/1920 | Kanta et al. |
| 1,623,075 | A | 4/1927 | Thomas |
| 1,662,882 | A | 3/1928 | Clark |
| 2,028,872 | A | 1/1936 | Kellogg |
| 2,083,315 | A | 6/1937 | Casso |
| 2,212,703 | A | 8/1940 | Suffich |
| 2,430,230 | A | 11/1947 | Kuhl |
| 2,547,745 | A | 4/1951 | Cade et al. |
| 2,605,550 | A | 8/1952 | Campbell |
| 2,954,612 | A | 10/1960 | Goldberger |
| 3,235,969 | A | 2/1966 | Rose |
| 3,376,650 | A | 4/1968 | Cook |
| 3,421,464 | A | 1/1969 | Cash |
| 4,502,232 | A | 3/1985 | Broders |
| 4,608,939 | A | 9/1986 | Lampley |
| 4,635,369 | A | 1/1987 | Powell |

(Continued)

*Primary Examiner*—Yaritza Guadalupe-McCall
(74) *Attorney, Agent, or Firm*—Jansson Shupe & Munger Ltd.

(57) ABSTRACT

A quilting template system and a method for selecting a template to facilitate quilting a border-like area of a craft-work with length-sides and width-sides meeting at corners. The template system includes a set of templates each having an edge of repeated patterns of equal pattern-length but differing in pattern-length from template to template, and a correlator indicating which template(s) of the set are usable for the craft-work without fractional-pattern use on either the length-sides or the width-sides thereof. The method includes a sequence of steps for selecting a template by using the correlator to indicate which templates are usable for quilting the entire border-like area without fractional-pattern use. The system preferably includes groups of templates, templates of each group each having patterns of equal pattern-length but differing in pattern-shapes from template to template within the group. Another aspect of the invention involves assemblages of templates on trays in uniplanar organized arrangement with adjacent templates having complementary edges. Yet another aspect involves a template for establishing a continuous stitch-line of repeated portions each with halves of inverted symmetry.

28 Claims, 6 Drawing Sheets

U.S. PATENT DOCUMENTS 4,945,642 A 8/1990 Saulietis
5,444,920 A 8/1995 Nelson
5,638,605 A 6/1997 Sligar
5,749,149 A 5/1998 Claytor
5,791,062 A * 8/1998 Walker ..... 33/563
5,926,966 A * 7/1999 Russell ..... 33/562
5,966,824 A 10/1999 Vazquez
6,112,425 A 9/2000 Nelson et al.
6,155,189 A 12/2000 Walner
6,216,354 B1 4/2001 Carbone
6,237,240 B1 5/2001 Nelson et al.
6,276,070 B1 * 8/2001 Hawley ..... 33/1 G
6,321,458 B1 11/2001 Hess
6,357,370 B1 3/2002 Fritz et al.
6,418,635 B1 7/2002 Nelson et al.
6,460,267 B1 10/2002 Cormack
6,722,051 B2 4/2004 Carlson et al.
6,839,971 B2 1/2005 Schafer et al.
6,854,189 B2 2/2005 Schafer
6,860,211 B2 3/2005 Valeriote et al.
6,877,243 B2 4/2005 Carlson et al.
6,918,189 B1 7/2005 McBrayer
6,925,724 B2 8/2005 Tandy
6,935,039 B1 8/2005 Hess
6,944,963 B2 9/2005 Amaru
7,185,441 B2 * 3/2007 Lockyer ..... 33/562
2003/0188675 A1 10/2003 Valeriote et al.

* cited by examiner

Border Curves

Lookup numbers = Inside border seam less 2 inches

Select the LCD factor that is common to both lookup numbers

| If Lookup # is: | Factors are: 2 | 3 | 4 | 5 | If Lookup # is: | Factors are: 2 | 3 | 4 | 5 |
|---|---|---|---|---|---|---|---|---|---|
| 1 or 61 | | | | | 31 or 91 | | | | |
| 2 or 62 | ✓ | | | | 32 or 92 | ✓ | | ✓ | |
| 3 or 63 | | ✓ | | | 33 or 93 | | ✓ | | |
| 4 or 64 | ✓ | | ✓ | | 34 or 94 | ✓ | | | |
| 5 or 65 | | | | ✓ | 35 or 95 | | | | ✓ |
| 6 or 66 | ✓ | ✓ | | | 36 or 96 | ✓ | ✓ | ✓ | |
| 7 or 67 | | | | | 37 or 97 | | | | |
| 8 or 68 | ✓ | | ✓ | | 38 or 98 | ✓ | | | |
| 9 or 69 | | ✓ | | | 39 or 99 | | ✓ | | |
| 10 or 70 | ✓ | | | ✓ | 40 or 100 | ✓ | | ✓ | ✓ |
| 11 or 71 | | | | | 41 or 101 | | | | |
| 12 or 72 | ✓ | ✓ | ✓ | | 42 or 102 | ✓ | ✓ | | |
| 13 or 73 | | | | | 43 or 103 | | | | |
| 14 or 74 | ✓ | | | | 44 or 104 | ✓ | | ✓ | |
| 15 or 75 | | ✓ | | ✓ | 45 or 105 | | ✓ | | ✓ |
| 16 or 76 | ✓ | | ✓ | | 46 or 106 | ✓ | | | |
| 17 or 77 | | | | | 47 or 107 | | | | |
| 18 or 78 | ✓ | ✓ | | | 48 or 108 | ✓ | ✓ | ✓ | |
| 19 or 79 | | | | | 49 or 109 | | | | |
| 20 or 80 | ✓ | | ✓ | ✓ | 50 or 110 | ✓ | | | ✓ |
| 21 or 81 | | ✓ | | | 51 or 111 | | ✓ | | |
| 22 or 82 | ✓ | | | | 52 or 112 | ✓ | | ✓ | |
| 23 or 83 | | | | | 53 or 113 | | | | |
| 24 or 84 | ✓ | ✓ | ✓ | | 54 or 114 | ✓ | ✓ | | |
| 25 or 85 | | | | ✓ | 55 or 115 | | | | ✓ |
| 26 or 86 | ✓ | | | | 56 or 116 | ✓ | | ✓ | |
| 27 or 87 | | ✓ | | | 57 or 117 | | ✓ | | |
| 28 or 88 | ✓ | | ✓ | | 58 or 118 | ✓ | | | |
| 29 or 89 | | | | | 59 or 119 | | | | |
| 30 or 90 | ✓ | ✓ | | ✓ | 60 or 120 | ✓ | ✓ | ✓ | ✓ |

FIG. 9

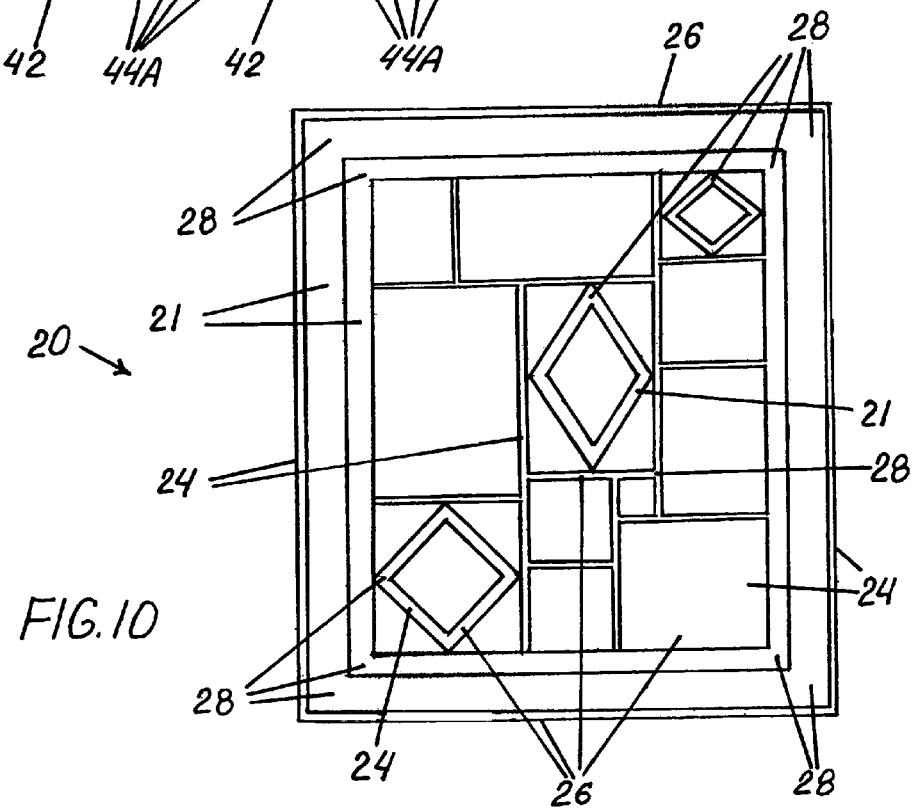

FIG. 10

QUILTING TEMPLATE SYSTEM

FIELD OF THE INVENTION

The invention generally relates to quilting tools, in particularly to templates for quilting border-like areas of a craft-work.

BACKGROUND OF THE INVENTION

A traditional method of making quilts is to make pieced blocks using a variety of fabrics and patterns. The blocks are then joined into rows by stitching a complementary piece of fabric between two blocks, called sashing. Similarly rows are joined together using more sashing fabric, creating a lattice effect. The intersection of the sashing pieces is called the sashing square or cornerstone. Once the main body of the quilt is completed, one or more borders are frequently added to frame the work.

The size of the borders will vary. If the quilt is square, all four borders will be the same size. If the quilt is rectangular, they will differ. When quilting a border area, it is important that the chosen quilting design symmetrically fill the space and be identical in each corner area. Finding quilting designs that work when the length-side and width-side are different and that flow around the corners consistently is difficult and requires many adjustments.

The size of the sashing strips will also vary depending on the size of the pieced blocks, the desired size of the finished quilt top, or even the amount of the fabric that is available. As with border areas for an entire craft-work (e.g., a bedspread), when quilting a sashing area it is important that the chosen quilting design symmetrically fill the space and be identical in each cornerstone area.

It is highly desirable to have a template system for choosing the right size design that will be repeated along unequal border destances and still go around the corners perfectly.

When the quilting is done by hand or using a regular sewing machine, the quilts are usually marked with lines for the quilting design and then stitched along the marked lines. The design may need to be adjusted to fit the area during the marking process. When using a long-arm quilting machine, following the marking lines is very difficult. Thus, it is desirable to have a template that makes final quilting with the long-arm quilting machine easier, more accurate and faster.

Most long-arm machines include a circular guard called a hopping foot surrounding the stitching needle. On most long-arm machines the hopping foot is dimensioned such that there is either ¼ inch or ⅜ inch from the needle to the outer edge of the hopping foot. When the machine is guided along any template, the hopping foot touches the template and the stitch line is a ¼ inch or ⅜ inch away from the template. This offset needs to be considered when using the templates to mark a quilt. Thus it is desirable to have a template that makes the final quilting with the long-arm quilting machine easier, and which can still be used for marking the quilt in advance.

While a variety of template devices have been developed, it would be highly desirable to have templates that can be stored in an organized fashion and in a minimum amount of space. This would facilitate choosing and using appropriate templates to facilitate accurate quilting operations.

OBJECTS OF THE INVENTION

It is an object of the invention to provide an improved template system overcoming some of the problems and shortcomings of the prior art, including those referred to above.

Another object of the invention is to provide a template system for quilting a border-like area of a craft-work with a design that can be repeated along the entire border-like area without fractional-pattern use and forming substantially symmetrical and identical corners of the craft-work.

Another object of the invention is to provide a method for selecting a template to facilitate quilting border-like areas of a craft-work.

Still another object of the invention is to provide a device and method to facilitate indicating which template(s) are usable for particular border distances.

Yet another object of the invention is to provide a template system to facilitate quilting with a long-arm quilting machine.

Another object of the invention is to provide a template system adapted to facilitate marking of a craft-work prior to quilting by hand or using a regular sewing machine.

Still another object of the invention is to provide a template system which can be stored in a minimum amount of surface, making the organizing easy.

How these and other objects are accomplished will become apparent from the following descriptions and the drawings.

SUMMARY OF THE INVENTION

This invention, which will be described in detail below, is an improvement in templates for quilting border-like areas of a craft-work with length-sides and width-sides meeting at corners with a continuous stitch-line of repeated patterns along the entire border-like area without fractional-pattern use.

The present invention provides a template system and a method for selecting a template to facilitate quilting the craft-work. It substantially eliminates the problem of asymmetrical corners and multiple adjustments of the pattern to achieve continuity in a stitch-line with substantially identical corner areas, especially when length-side and width-side distances of border-like areas are unequal. It also provides a choice of different pattern-designs and different pattern-heights of a particular design while accommodating a pattern-length usable for quilting a specific craft-work.

The inventive template system for quilting a border-like area of a craft-work with length-sides and width-sides meeting at corners includes a set of templates each having an edge of repeated patterns of equal pattern-length but differing in pattern-length from template to template, and a correlator indicating which template(s) are usable for the craft-work without fractional-pattern use on either the length-sides or the width-sides thereof.

The present invention provides a method for selecting a template to facilitate quilting a border-like area of a craft-work with length-sides and width-sides meeting at corners, including: providing a set of templates each having an edge of repeated patterns of equal pattern-length but differing in pattern-length from template to template; ascertaining the distance along the length-side and the distance along the width-side; providing a correlator indicating which template(s) are usable for particular distances without fractional-pattern use; using the correlator to indicate a first subset of the templates usable along the length-sides without fractional-pattern use; using the correlator to indicate a second subset of the templates usable along the width-sides without fractional-pattern use; and selecting a template common to the first and second subsets for use in quilting the entire border-like area.

The correlator to facilitate selection of a template for quilting border-like areas of a craft-works from the set of templates includes a border-distance field having a discrete number of border-distances, a pattern-length field having a discrete number of differing pattern-lengths corresponding to the templates, and a yes indicator of some sort for whatever pattern-length(s) are usable without fractional-pattern use for each discrete border-distance.

In highly preferred embodiments of the invention the correlator is in the form of a chart on which the border-distance field is a discrete number of rows with the discrete number of border distances, and the pattern-length field is a discrete number of border-distance-intersecting rows with the discrete number of pattern-lengths. The correlator may also be in a form of computer program designed for input of ascertained border distances to compute pattern-lengths usable for a craft-work based on its border distances.

In the event the correlator does not provide any pattern-lengths for a particular ascertained border distance, the border distance which is closest to the ascertained distance and which provides usable pattern-length(s) can be utilized to select an appropriate template for use in quilting the entire border-like area.

The set of templates preferably includes groups of templates, the templates of each group each having patterns of equal pattern-length but differing in pattern-shapes from template to template. In some embodiments, different pattern-shape may refer to pattern-heights differing from template to template. In other embodiments, the templates of each group may have pattern-designs different from template to template.

In fact, highly preferred embodiments of the method provide a means to first select a group or groups of acceptable templates, before a final choice of a particular template from a selected group. The method steps include: providing a set of template groups, the templates of each group each having an edge of repeated patterns of equal pattern-length but differing in pattern-shapes from template to template, and each group having pattern-lengths differing from group to group; ascertaining the distance along the length-side and the distance along the width-side; providing a correlator indicating which group(s) of templates are usable for particular distances without fractional-pattern use; using the correlator to indicate a first subset of group(s) of templates usable along the length-sides without fractional-pattern use; using the correlator to indicate a second subset of group(s) of templates usable along the width-sides without fractional-pattern use; selecting a group of templates common to the first and second subsets of groups for use in quilting the entire border-like area; and choosing a template from the selected group of templates.

Another important aspect of the invention is assemblages of templates on trays in uniplanar organized arrangement with adjacent templates having complementary edges. An assemblage may be formed by one group of templates having patterns of equal pattern-length but differing in pattern-shapes from template to template. Alternatively, templates all having same pattern-shape but differing in pattern-length from template to template may form an assemblage. The pattern-shape may refer to the pattern-height or pattern-design. There may be a number of various combinations of templates forming an assemblage on each tray. The tray includes a planar storage surface and a surrounding raised frame. The correlator is in the form of a chart is preferably on each of the trays.

In certain highly preferred embodiments, each tray includes a raised portion defining recesses each complementary to a ring-like marking spacer received therein for storage when not in use. Each recess has at least one adjacent finger-space to facilitate withdrawal of the marking spacer.

It is highly preferred for the inventive quilting template system to include a plurality of assemblages of templates. Each assemblage of templates is on a respective tray. The plurality of trays preferably fit into a rack. The rack may be designed to be stackable which minimizes the surface space required to store the trays.

In the most preferred embodiments of the inventive template system, the templates are substantially transparent and include registration lines on the templates facilitating template positioning on the craft-work. In certain highly preferred embodiments of this type, the registration lines include substantially perpendicular guide-lines. The registration lines also preferably include a miter line facilitating positioning of the template on the corner of the border-like area of the craft-work.

Another aspect of this invention involves a template for establishing a continuous stitch-line of repeated portions each with halves of inverted symmetry. The template has an edge with repeated patterns, each pattern having pattern-halves offset from inverted symmetry to the extent necessary to accommodate an offset-tool of particular radius (such as a hopping foot as described above or a spacer also described above) sufficiently to achieve the stitch-line with halves of inverted symmetry.

The term "border-like area," as used herein, refers to a region along an outer edge of a field of a craft-work, the field having a number of corners. Such field may include the entire craft-work with the border-like area referring to a border strip surrounding the craft-work. Alternatively, the field may be just a section of the craft-work, and the border-like area is either a strip surrounding such section (e.g, sashing), or an interior region of uniform width along the edge of the section.

The term "field" is used herein to describe a region or area in the correlator, such region or area containing multiple values for the variables being considered within the field.

The term "continuous," as used herein referring to a stitch-line, means a line extending without irregularity or interruption the quilting of which can be completed with a non-broken thread.

BRIEF DESCRIPTION OF THE DRAWINGS

FIG. 9 is an example of a correlator in form of a chart.

FIG. 10 is a plan view of a craft-work.

DETAILED DESCRIPTION OF PREFERRED EMBODIMENTS

Figure 1:
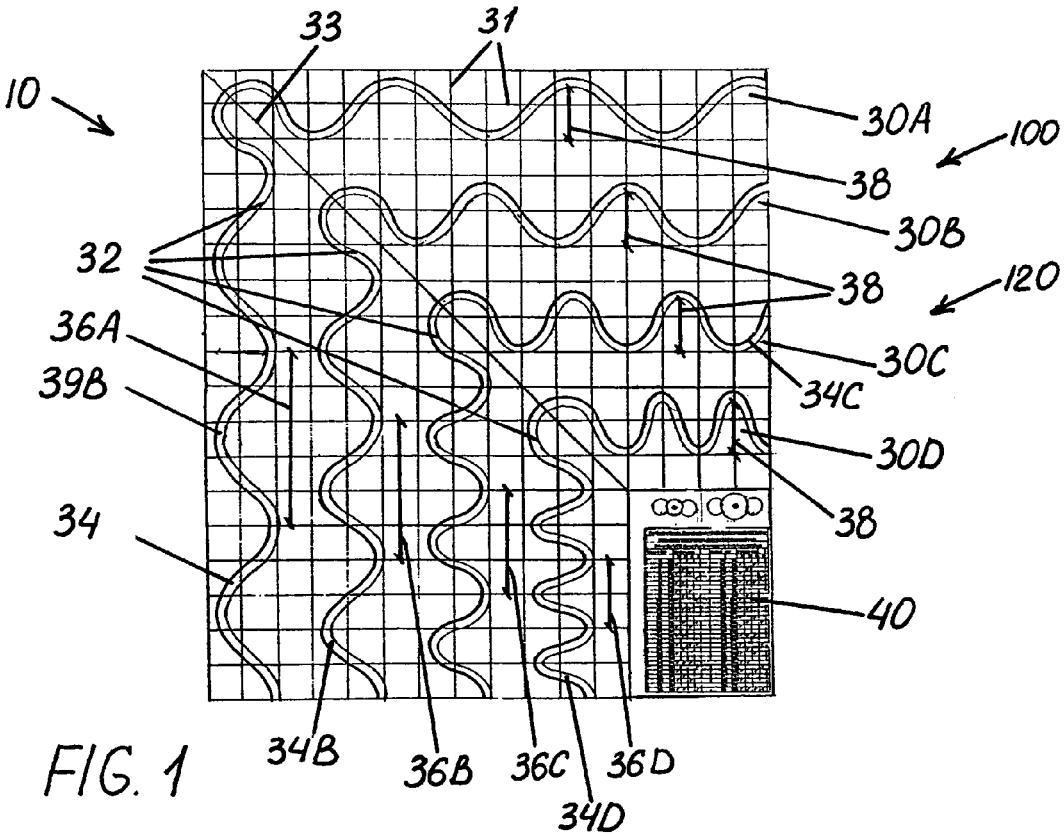
FIG. 1 is a plan view of an assemblage of a set of templates all of which have similar pattern-shapes (height and design) and each of which has its edge with repeated patterns of equal pattern-length, the pattern-lengths differing from template to template.

Referring to the FIGS. 1 and 10, a template system for quilting a border-like area 21 of a craft-work 20 with length-sides 24 and width-sides 26 meeting at corners 28, includes a set 10 of templates 30 each having an edge 32 formed by repeated patterns 34 of equal pattern-length 36 but differing in pattern-length 36A, 36B, 36C and 36D from template 30A to template 30B, to template 30C and to template 30D, and a correlator 40 indicating which template or templates of the set 10 are usable for quilting craft-work 20 without use of fractional pattern 34 on either length-sides 24 or width-sides 26.

As best seen on FIG. 9, correlator 40 to facilitate selection of a template for quilting border-like areas 21 of craft-works 20 from the set 10 of templates 30 includes a border-distance field 42 having a discrete number of border-distances 23 (also referred to as "lookup numbers"), a pattern-length field 44 having a discrete number of differing pattern-lengths 36 (also referred to as "factors") corresponding to templates 30, and a yes indicator 46 (shown as check-marks) for each differing pattern-length 36 usable for each discrete border-distance 23 without use of fractional pattern 34.

FIG. 9 illustrates correlator 40 in the form of a chart 41 on which border-distance field 42 is a discrete number of rows 42A with the discrete number of border distances 23, and pattern-length field 44 is a discrete number of rows 44A with the discrete number of pattern-lengths 36 and intersecting border-distance rows 42A.

Figure 2:
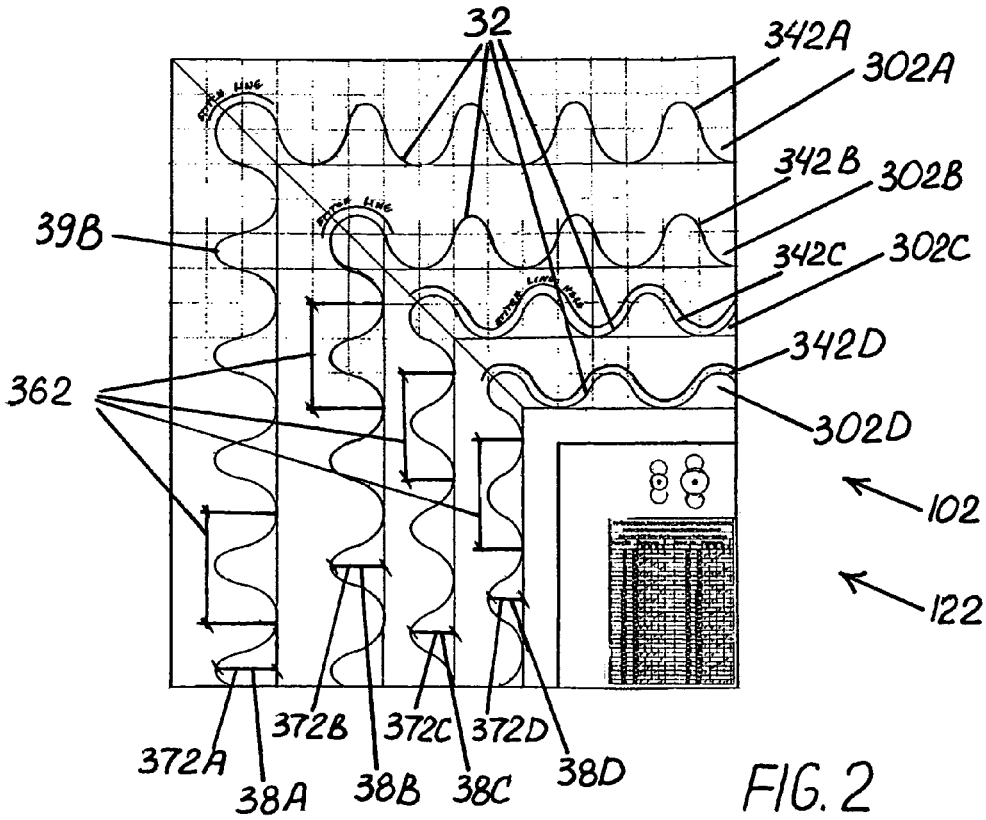
FIG. 2 is a plan view of an assemblage of a group of templates all of which have pattern-shapes of similar pattern-design with pattern-heights-differing from template to template, each template of the group having repeated patterns of equal pattern-length, with the pattern-lengths being the same from template to template in the group.
Figure 3:
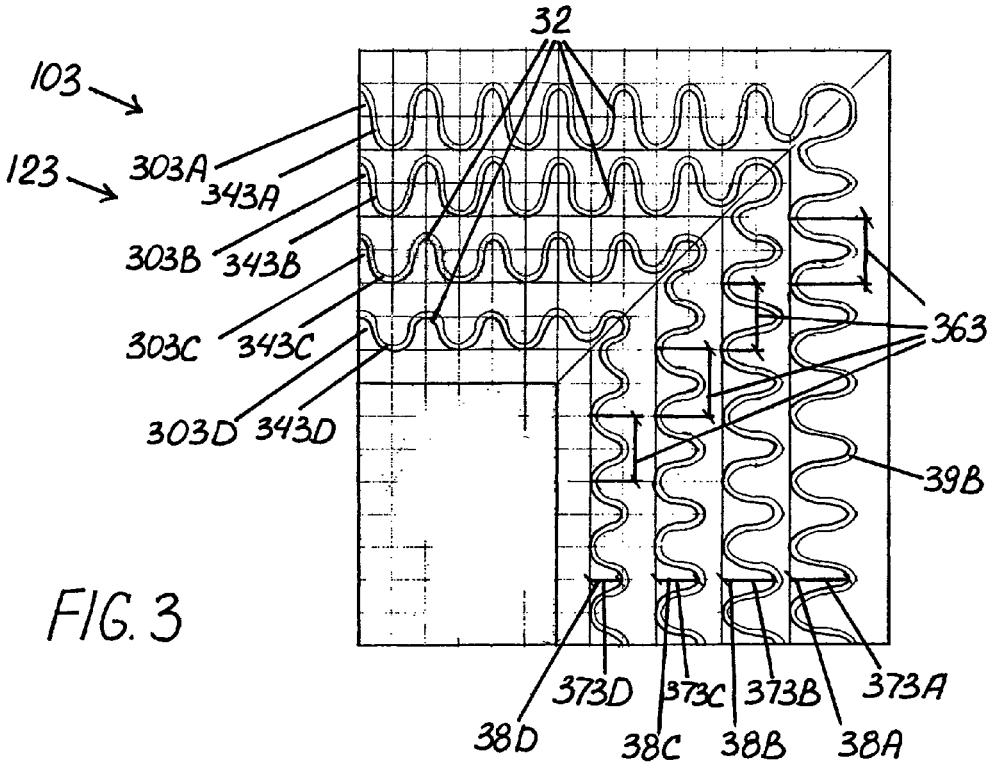
FIG. 3 is a plan view of another assemblage of a group of templates, the only difference between the templates of FIG. 2 and templates of FIG. 3 being a different pattern-length for each group.
Figure 4:
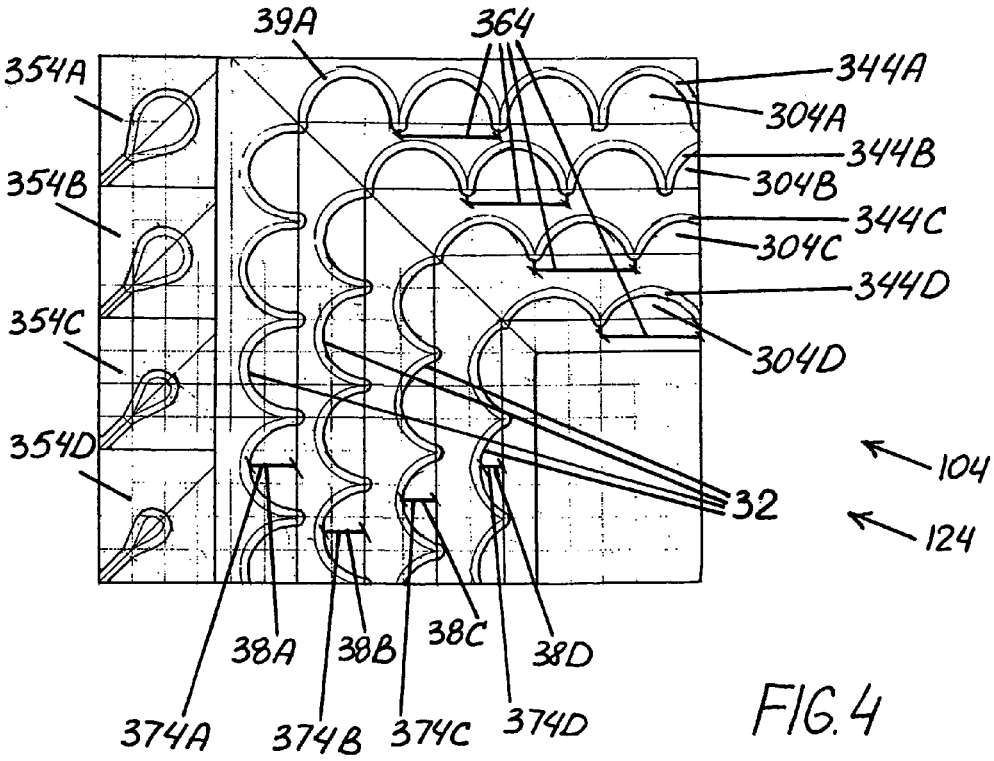
FIG. 4 is a plan view of yet another assemblage of a group of templates having a pattern-design which is different from the pattern-design of templates of groups of FIGS. 2 and 3. Assemblage of FIG. 4 further includes alternative corner-finish templates corresponding to templates of the group of FIG. 4.

Set 10 of templates 30 preferably includes groups of templates. FIGS. 2, 3 and 4 show groups 102, 103 and 104.

FIG. 2 shows group 102 of templates 302A, 302B, 302C and 302D each having patterns 342A, 342B, 342C and 342D of equal pattern-length 362 but differing in pattern-shapes 372A, 372B, 372C and 372D among templates 302A, B, C and D.

FIG. 3 shows group 103 of templates 30A, 303 B, 303C and 303D each having patterns 343A, 343B, 343C and 343D of equal pattern-length 363 but differing in pattern-shapes 373A, 373B, 373C and 373D from template 303A to template 303B, to template 303C and to template 303D. Templates of group 103 are different from templates of group 102 in their respective pattern lengths 362 and 363.

FIG. 4 shows group 104 of templates 304A, 304 B, 304C and 304D each having patterns 344A, 344B, 344C and 344D of equal pattern-length 364 but differing in pattern-shapes 374A, 374B, 374C and 374D from template 304A to template 304B, to template 304C and to template 304D. Templates of group 104 are different from templates of groups 102 and 103 in their respective pattern lengths 362, 363 and 364, and templates of group 104 have pattern-design 39A which is different from pattern-design 39B of templates of groups 102 and 103.

FIGS. 2, 3 and 4 also illustrate that pattern-shape may refer to pattern-heights 38A, B, C and D differing among templates A, B, C and D.

Figure 5:
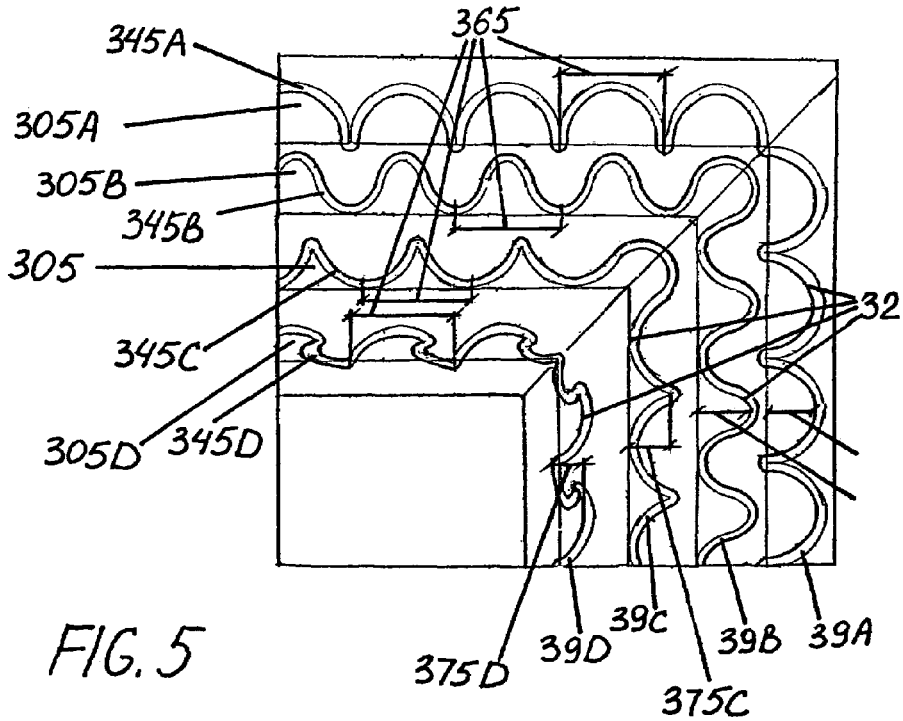
FIG. 5 is a plan view of an assemblage of a group of templates all of which have repeated patterns of equal pattern-length, with the pattern-lengths being the same from template to template in the group, but the pattern-shapes differing from template to template in the group in both pattern-designs and pattern-heights.

FIG. 5 illustrates a group 105 of templates 305A, 305 B, 305C and 305D each having patterns 345A, 345B, 345C and 345D of equal pattern-length 365 but differing in pattern-shapes 375A, 375B, 375C and 375D among templates 305A, B, C and D. FIG. 5 further illustrates that pattern-shapes 375A, 375B, 375C and 375D are also different pattern-designs 39A, 39B, 39C and 39D. In FIG. 5, pattern-designs differ from template to template within group 105. Pattern-designs may also be different from group to group. As illustrated in FIGS. 2 and 3, groups 102 and 103 have design 39B, and group 104 shown in FIG. 4 has design 39A.

Another important aspect of the invention is assemblages 12 of templates 30 on trays 50 in uniplanar organized arrangement with adjacent templates 30A and 30B, 30B and 30C, 30C and 30D having complementary edges 32.

FIGS. 2, 3 and 4 illustrate assemblage 122 formed by group 102 of templates 302A, B, C and D, assemblage 123 formed by group 103 of templates 303A, B, C and D, and assemblage 124 formed by group 104 of templates 304A, B, C, and D, each of assemblages 122, 123 and 124 having its patterns 34 of equal pattern-length 36 but differing in pattern-heights 38 among templates A, B, C and D of each group.

FIG. 4 further illustrates assemblage 124 of templates having pattern-design 39A which allows for at least two different corner finishes. Assemblage 124 includes alternative corner-finish templates 354A, 354B, 354C and 354D configured and sized to complete designs of corresponding templates 304A, 304B, 304C and 304D.

FIG. 1 shows assemblage 120 formed by group 100 of templates 30A, 30B, 30C and 30D all having the same pattern-design 39B but differing in pattern-lengths 36A, 36B, 36C and 36D among templates 30A, B, C and D. FIG. 1 further illustrates group 100 with all templates in the group having the same pattern-height 38.

Figure 6:
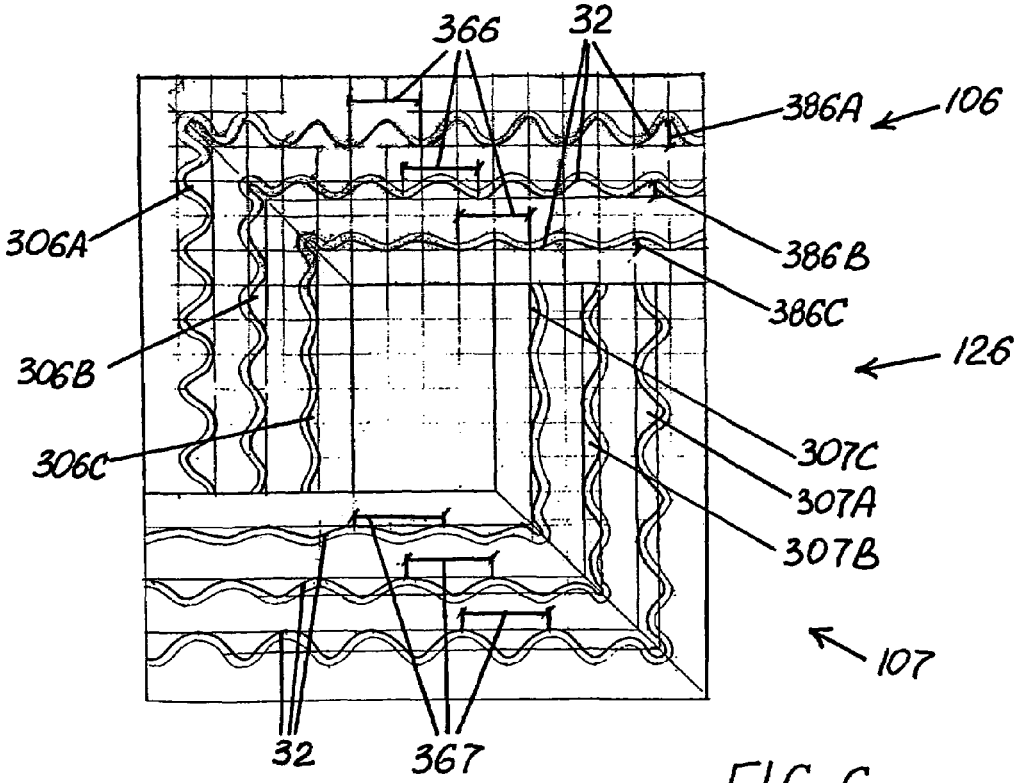
FIG. 6 is a plan view of an assemblage of two groups of templates, the only difference between the templates of one group from the templates of the other group being a different pattern-length for each group.

FIG. 6 shows an example of tray 50 with an assemblage 126 formed by two groups of templates, group 106 of templates 306A, 306B and 306C, and group 107 of templates 307A, 307B and 307C. Templates of group 106 all have equal pattern-length 366 but different pattern-heights 386A, 386B and 386C. Group 107 has template relationships similar to group 106. Templates of group 107 have pattern-length 367 which is different than pattern-length 366 of templates of group 106.

Figure 7:
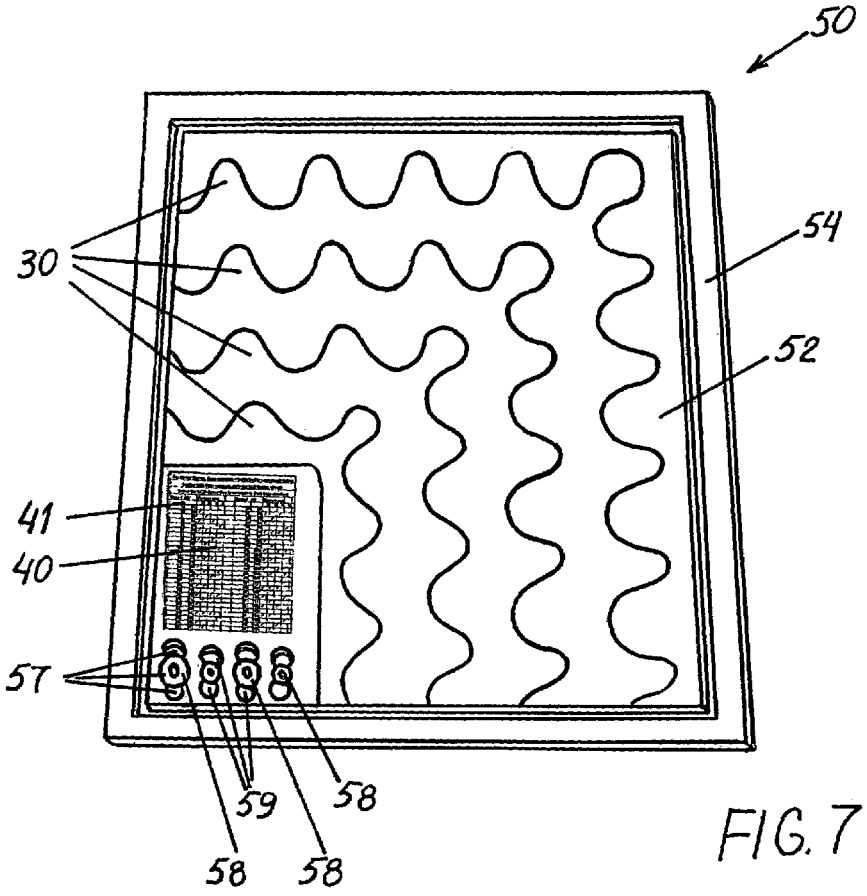
FIG. 7 is a perspective view of a tray.

FIG. 7 shows tray 50 which includes a planar storage surface 52 and a surrounding raised frame 54. Tray 50 shown in FIG. 7 includes correlator 40 in the form of chart 41.

Figure 8:
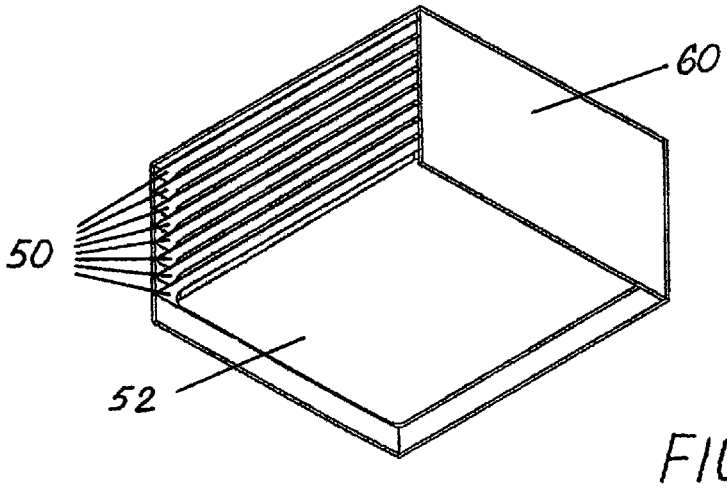
FIG. 8 is a perspective view of a rack.

FIG. 8 illustrates a rack 60 for storage of a plurality of trays 50 to hold assemblages of templates (not shown in FIG. 8).

Templates 30 preferably include registration lines facilitating template positioning on craft-work 20. As best shown in FIG. 1, the registration lines include substantially perpendicular guide-lines 31 and a miter line 33 facilitating positioning of template 30 on corner 28 of border-like area 22 of craft-work 20.

It is seen in FIG. 7 that tray 50 further includes a raised portion 56 defining recesses each complementary to a ring-like marking spacer 58 received therein for storage when not in use. Each recess 57 has at least one adjacent finger-space 59 to facilitate withdrawal of marking spacer 58.

Figure 11:
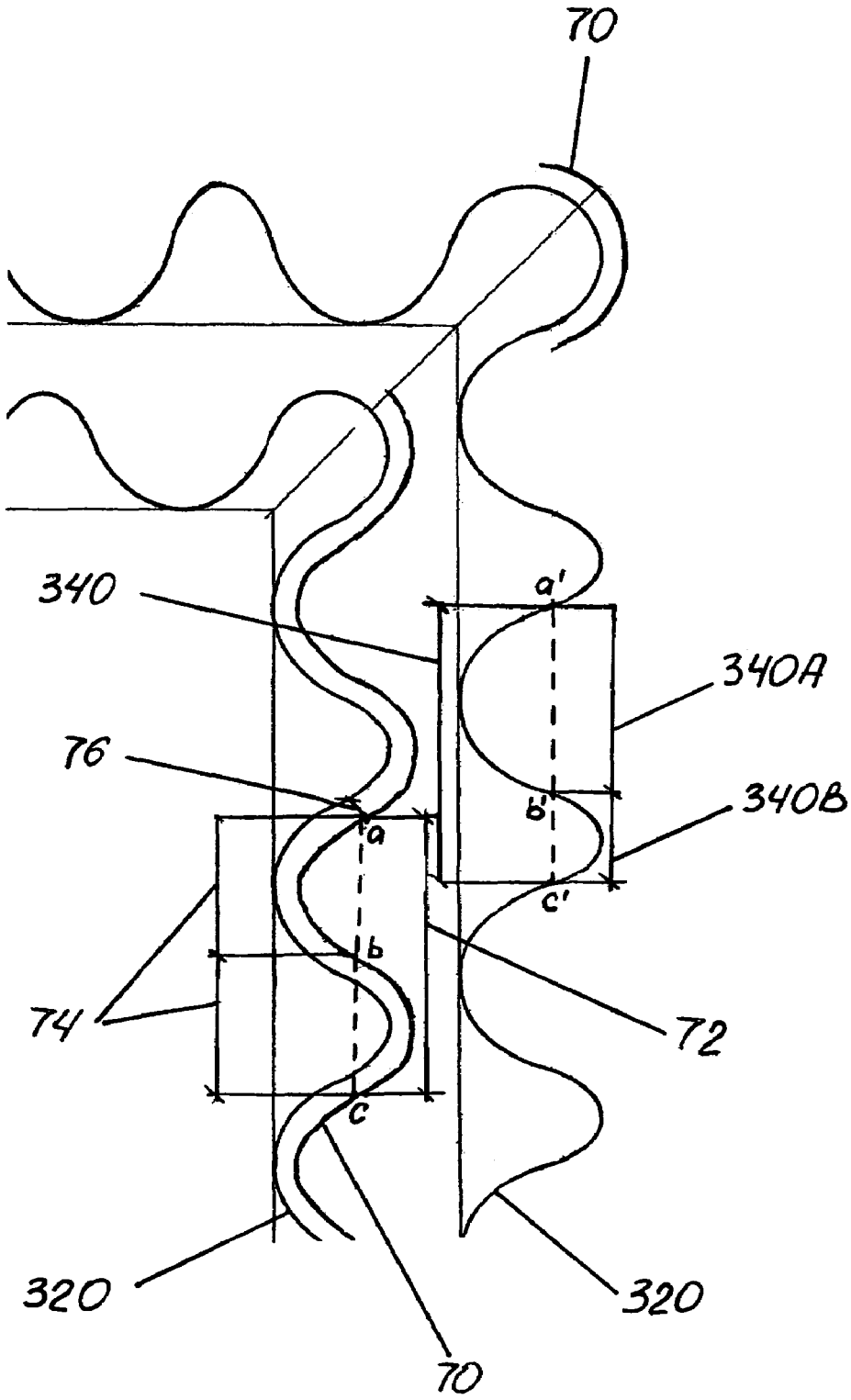
FIG. 11 is a plan view of templates for establishing a continuous stitch-line of repeated portions each with halves of inverted symmetry

FIG. 11 illustrates another aspect of this invention involving templates 300 for establishing a continuous stitch-line 70 of repeated portions 72 each with halves 74 of inverted symmetry. "Inverted symmetry" is herein defined as follows. The portion of stitch-line 70 designated by the letters a, b, and c is defined as having inverted symmetry while the portion of template edge 320 designated by the letters a', b', and c' is defined as not having inverted symmetry. Line segment a, and line segment b, c are equal in length and shape except that one is an inversion of the other. Line segment a', b' and line segment b', c' however do not have such a similarity relationship. This comparison exemplifies the difference between inverted symmetry and inverted non-symmetry.

Referring again to FIG. 11, template 300 has an edge 320 with repeated patterns 340. Each pattern 340 has pattern-halves 340A and 340B offset from inverted symmetry (thus yielding inverted non-symmetry) to the extent 76 necessary to accommodate an offset-tool like a marking spacer 58 best shown in FIG. 7 of particular radius. Such radius is sufficient to achieve the stitch-line 70 with halves 74 of inverted symmetry.

While the principles of the invention have been shown and described in connection with specific embodiments, it is to be understood that such embodiments are by way of example and are not limiting.

The invention claimed is:

1. A method for selecting a template to facilitate quilting a border-like area of a craft-work with length-sides and width-sides meeting at corners, comprising:

providing a set of templates each having an edge of repeated patterns of equal pattern-length but differing in pattern-length from template to template;

ascertaining the distance along the length-side and the distance along the width-side;

providing a correlator indicating which template(s) are usable for particular distances without fractional-pattern use;

using the correlator to indicate a first subset of the templates usable along the length-sides without fractional-pattern use;

using the correlator to indicate a second subset of the templates usable along the width-sides without fractional-pattern use; and selecting a template common to the first and second subsets for use in quilting the entire border-like area.

2. The method of claim 1 wherein the correlator includes a border-distance field having a discrete number of border-distances; a pattern-length field having a discrete number of differing pattern-lengths corresponding to the templates of the set; and a yes indicator for each differing pattern-length usable for each discrete border-distance without fractional-pattern use.

3. The method of claim 2 wherein the correlator is in the form of a chart on which:

the border-distance field is a discrete number of rows with the discrete number of border-distances; and the pattern-length field is a discrete number of border-distance-intersecting rows with the discrete number of pattern-lengths.

4. A method for selecting a template to facilitate quilting a border-like area of a craft-work with length-sides and width-sides meeting at corners, comprising:

providing a set of template groups, the templates of each group each having an edge of repeated patterns of equal pattern-length but differing in pattern-shapes from template to template, and each group having pattern-lengths differing from group to group;

ascertaining the distance along the length-side and the distance along the width-side;

providing a correlator indicating which group(s) of templates are usable for particular distances without fractional-pattern use;

using the correlator to indicate a first subset of group(s) of templates usable along the length-sides without fractional-pattern use;

using the correlator to indicate a second subset of group(s) of templates usable along the width-sides without fractional-pattern use;

selecting a group of templates common to the first and second subsets of groups for use in quilting the entire border-like area; and choosing a template from the selected group of templates.

5. The method of claim 4 wherein the correlator includes a border-distance field having a discrete number of border-distances; a pattern-length field having a discrete number of differing pattern-lengths corresponding to the templates of the set; and a yes indicator for each differing pattern-length usable for each discrete border-distance without fractional-pattern use.

6. The method of claim 5 wherein the correlator is in the form of a chart on which:

the border-distance field is a discrete number of rows with the discrete number of border-distances; and the pattern-length field is a discrete number of border-distance-intersecting rows with the discrete number of pattern-lengths.

7. The method of claim 4 wherein the templates of each group have differing pattern-heights.

8. The method of claim 4 wherein the templates of each group have differing pattern-designs.

9. The method of claim 4 wherein assemblages of templates are on trays in uniplanar organized arrangement, adjacent templates having complementary edges.

10. The method of claim 9 wherein the correlator is in the form of a chart on each of the trays.

11. The method of claim 9 wherein each tray includes a planar storage surface and a surrounding raised frame.

12. The method of claim 9 wherein the system includes a plurality of assemblages of templates, each assemblage of templates on a respective tray, and the trays being arranged in a rack.

13. A template system for quilting a border-like area of a craft-work with length-sides and width-sides meeting at corners, comprising:

a set of templates each having an edge of repeated patterns of equal pattern-length but differing in pattern-length from template to template; and a correlator indicating which template(s) are usable for the craft-work without fractional-pattern use on either the length-sides or the width-sides thereof.

14. The template system of claim 13 wherein the correlator has a border-distance field with a discrete number of border-distances, a pattern-length field with a discrete number of differing pattern-lengths corresponding to the templates of the set; and a yes indicator for each differing pattern-length usable for each discrete border-distance without fractional-pattern use.

15. The template system of claim 14 wherein the correlator is in the form of a chart on which:

the border-distance field is a discrete number of rows with the discrete number of border-distances; and the pattern-length field is a discrete number of border-distance-intersecting rows with the discrete number of pattern-lengths.

16. The template system of claim 13 wherein the set includes groups of templates, the templates of each group each having patterns of equal pattern-length but differing in pattern-shapes from template to template.

17. The template system of claim 16 wherein the templates of each group have differing pattern-heights.

18. The template system of claim 16 wherein the templates of each group have differing pattern-designs.

19. The template system of claim 16 wherein assemblages of templates are on trays in uniplanar organized arrangement, adjacent templates having complementary edges.

20. The template system of claim 19 wherein each assemblage of templates is on a respective tray, and the trays being arranged in a rack.

21. The template system of claim 19 wherein each group forms an assemblage.

22. The template system of claim 19 wherein each tray includes a planar storage surface and a surrounding raised frame.

23. The template system of claim 19 wherein the correlator is in the form of a chart on each of the trays.

24. The template system of claim 19 wherein the templates are substantially transparent and include registration lines thereon facilitating template positioning on the craft-work.

25. The template system of claim 24 wherein the registration lines include substantially perpendicular guide-lines.

26. The template system of claim 25 wherein the registration lines further include a miter line facilitating positioning of the template on the corner of the border-like area of the craft-work.

27. The template system of claim 19 wherein each tray includes a raised portion defining recesses each complementary to a ring-like marking spacer received therein for storage when not in use.

28. The template system of claim 27 wherein each recess has at least one adjacent finger-space to facilitate withdrawal of the marking spacer.

* * * * *